United States Patent [19]

Willett et al.

[11] 4,389,225

[45] Jun. 21, 1983

[54] ELECTROSTATIC PRECIPITATOR HAVING HIGH STRENGTH DISCHARGE ELECTRODE

[75] Inventors: Howard P. Willett, Darien; Even Bakke, Stamford, both of Conn.

[73] Assignee: Peabody Process Systems, Inc., Stamford, Conn.

[21] Appl. No.: 247,797

[22] Filed: Mar. 26, 1981

Related U.S. Application Data

[63] Continuation-in-part of Ser. No. 85,470, Oct. 11, 1979, abandoned.

[51] Int. Cl.[3] ..... B03C 3/74

[52] U.S. Cl. ..... 55/118; 55/146; 55/122; 55/127; 55/150

[58] Field of Search ..... 55/2, 10, 119, 122, 55/127, 118, 150–153; 361/226–228

[56] References Cited

U.S. PATENT DOCUMENTS

| | | | |
|---|---|---|---|
| 1,440,887 | 1/1923 | Nesbit | 55/127 |
| 2,631,685 | 3/1953 | Hardy | 55/119 |
| 2,722,283 | 11/1955 | Klemper et al. | 55/150 |
| 3,053,029 | 9/1962 | De Seversky | 55/118 |
| 3,819,985 | 6/1974 | Dusevoir | 55/151 |
| 4,194,888 | 3/1980 | Schwab et al. | 55/2 |
| 4,247,307 | 1/1981 | Chang | 55/2 |

FOREIGN PATENT DOCUMENTS

| | | | |
|---|---|---|---|
| 242599 | 5/1946 | Switzerland | 55/398 |
| 30194AD | of 1911 | United Kingdom | 55/150 |

*Primary Examiner*—Bernard Nozick

*Attorney, Agent, or Firm*—St.Onge, Steward, Johnston & Reens

[57] ABSTRACT

There is disclosed an electrostatic precipitator with a discharge electrode having dimensional and configuration characteristics which provide high field strength and high current density particularly in a wet electrostatic precipitator. The round cylindrical collector tube of length (L) and with an inner diameter (D) has a coaxially positioned discharge electrode having an electrode supporting mast of a diameter from 0.25 to 0.40 D with an electrically conducting closed screw flight secured to the mast. The screw flight has an overall diameter (d) of from 0.33 to 0.67 D with a pitch of from D-d/2 to D-d and an overall length of from one screw revolution to L-(D-d), preferably one-half L or less and most preferably one to two revolutions. The short screw flight is economical and readily adjusted. The screw flight has a thickness of from about 0.05 to 0.15 inch and has a symmetrically curved outer edge. The collector tube is flared at its lower end to direct water away from the electrode mast as the water is discharged from the tube. The discharge electrode is supported from above and centered by means of adjustable tie rods at its lower end.

5 Claims, 3 Drawing Figures

36
24
26
18
20
10
34
D
22
22a
16
25
P
ℓ
L
14
a
32
20a
28
30

ELECTROSTATIC PRECIPITATOR HAVING HIGH STRENGTH DISCHARGE ELECTRODE

This application is a continuation-in-part of U.S. application Ser. No. 85,470 filed Oct. 11, 1979 now abandoned.

FIELD OF THE INVENTION

This invention relates to electrostatic precipitators and more particularly to a high field strength discharge electrode for electrostatic precipitators.

DESCRIPTION OF THE PRIOR ART

Electrostatic precipitators have been used for some time to remove particulate material from air or gases by the use of high voltage electrodes to precipitate the fine particles onto a grounded surface. The general configuration of such prior art electrostatic precipitators is for the collector electrode to be in the shape of a tube or cylinder with a central discharge electrode for creating an electric field between it and the tube wall collector electrode.

The prior art discharge electrodes have been of many shapes ranging from a single wire to spiked or pronged electrodes and those in a helix or helical spiral formed of wire or a ribbon of electrically conductive material such as shown in U.S. Pat. Nos. 1,440,887 (Nesbit), 3,819,985 (Dusevoir), 3,966,436 (Archer) and 3,970,437 (Van Diepenbrock et al). Other prior art helical electrodes are disclosed generally in U.S. Pat. Nos. 1,325,124; 1,357,201; 1,357,886, 2,505,907 and British Pat. No. 30,194.

These prior art electrode designs for electrostatic precipitators each have one or more short comings, however. In some of them there is insufficient mechanical strength to endure vibration or corrosion during long usage. Others do not provide a strong enough field strength or else the field is not symmetrical. Other prior art electrodes have sharp or peaked edges which reduces the voltage which can be applied to the electrode before sparkover. In some cases these prior art electrode designs are more expensive to manufacture and/or to maintain.

Mechanical strength and durability of the discharge electrode design is important since the electostatic precipitator must function over an extended period of time without maintenance to replace or to align the electrode. Further, the electrostatic field from the discharge electrode should be as symmetrical as possible to increase the sparkover voltage and thereby maintain a high strength field. A symmetrical field minimizes local sparking and permits higher voltage and field strengths to be used. Further, the field gap of the discharge electrode and the active electrode length should be fully adjustable in use and installation.

Accordingly, it is an object of the invention to provide a high field strength discharge electrode for electrostatic precipitator which has the mechanical strength to withstand vibration and corrosion;

It is a further object of the invention to provide a discharge electrode of the above character which forms symmetrical field with a minimum of local sparking.

Another object of the invention is to provide a discharge electrode of the above character wherein the discharge electrode can be accurately aligned within the collector electrode.

A further object of the invention is to provide a discharge electrode of the above character wherein the field gap and active electrode length is adjustable in use and in installation.

Other objects of the invention will in part be obvious and will in part appear hereinafter.

The invention accordingly comprises the features of construction, combination of elements, and arrangement of parts which will be exemplified in the construction hereinafter set forth, and the scope of the invention will be indicated in the claims.

SUMMARY OF THE INVENTION

The electrostatic precipitator of the invention comprises a cylindrical collector electrode having a flared lower end for remote discharge of water or liquid with a discharge electrode centered within the grounded collector tube. The discharge electrode comprises a high field strength section made of screw conveyor flights on a relatively large diameter electrode mast. The collection section is in the form of a straight, relatively large diameter tube. The screw flights have an outer edge which is smooth and rounded for the creation of a uniform and high strength field between the screw flight edges and the collector tube surface.

The collector tube has an inner diameter (D) and the discharge electrode mast has an outer diameter of from 0.25 to 0.40D with the total screw flight diameter (d) being 0.33 to 0.67D, and preferably 0.42 to 0.50D. The pitch of the screw flight of the discharge electrode is from D-d/2 to D-d and preferably about D-d. The electrode support mast diameter is determined by balancing the field strength and the sparkover distance. The ratio of the collector tube diameter (D) and the mast diameter is preferably about 3. The length of the active helical electrode is from L-(D-d), to one complete helix revolution, preferably less than one-half L and most preferably from one to two complete helix revolutions.

The electrode mast is suspended from a high voltage beam at the top and is secured by tie rods and alignment clamps at its lower end for adjustability and centering of the discharge electrode within the collector tube. While the discharge electrode of the invention may be useful in other types of electrostatic precipitators it is most useful in wet electrostatic precipitators wherein the collector tube wall is maintained wet by the spraying of water and/or by condensation of water from water vapor in the gases passing through the collector tubes.

DETAILED DESCRIPTION OF A PREFERRED EMBODIMENT OF THE INVENTION

Figures 1, 3:
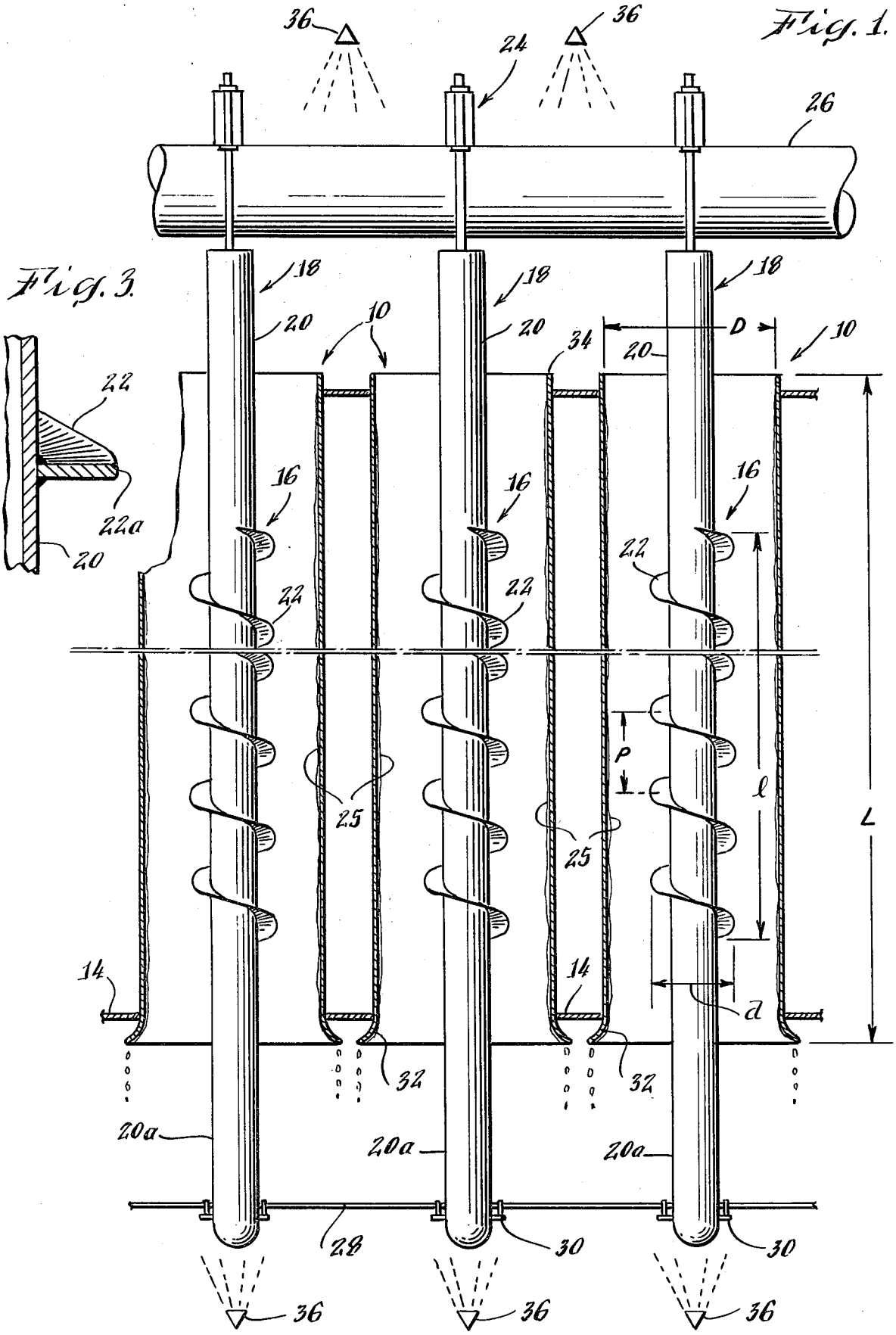
FIG. 1 is a partial side section view of an electrostatic precipitator employing the collector tube electrodes and discharge electrodes of the present invention.
FIG. 3 is an enlarged detail view of a cross section of the screw flight and its attachment to the electrode mast.

The electrostatic precipitator of the invention as shown in FIG. 1 comprises a plurality of collector tubes 10 held in an upper tube sheet 12 and a lower tube sheet 14 and which have a discharge electrode 16 centered along the axis 18 of each collector tube.

The discharge electrode 16 comprises an electrode mast 20 to which electrode screw flights 22 are secured. The mast is made of electrically conductive material with the screw flights fastened thereto. The corona current flows between the outer periphery 22a of the screw flights and the collector tube 10. Dust particles must pass through the gap between the screw flight 22a and the water film 25 where the field strength is very high. Dust particles will quickly be charged with ions and the strong field will drive them to the water film 25 to be removed from the gas passing through the precipitator.

In the precipitator there are a number of collector tubes which are held by the upper and lower tube sheets and spaced from one another. Preferably the collector tubes are aligned in rows and an electrode support beam 24 and high voltage insulator beam 26 are used to suspend the discharge electrodes in the collector tubes. The discharge electrode mast 20 is held at its lower end 20a by adjustable tie rods 28 and alignment clamps 30 to center the electrode mast along the axis of the collector tube and to provide for adjustability of the alignment when installed.

The bottom end of the collector tube is preferably flared as shown at 32 so that the water film 25 passing over the inside surface of the collector tube will exit from the collector tube at a greater distance from the electrode mast than the water film inside the collector tube and thereby prevent local sparking to the water surface.

The diameter D of the collector tube 10 may vary from about 8 to 16 inches, but is preferably about 10 to 12 inches in diameter. It has been found that the current density, electrostatic field shape and the field strength are all affected by:

(1) the outer diameter (d) of the helical screw flight, (2) the pitch (p) of the helix, and (3) the overall length (l) of the helix.

With a given diameter D and length L of the collector tube, the outer diameter (d) of the helix should be from 0.33D to 0.67D and preferably about 0.5D. The pitch (p) of the helix is preferably from (D-d)/2 to D-d. The overall length (l) of the discharge electrode helix is determined by the required corona current and typically is in the range from one complete helix revolution, to L-(D-d). The length (l) of the helix is most preferably one to two complete helix revolutions, with the helix at the lower or entrance end of the collector tube. Such a shorter helix is easier to design within the collector tube and is economical from a power consumption standpoint. The helical electrode is preferably less than one-half L. The pitch of the screw electrode is preferably more than 1.2 electrode gap, i.e. if the electrode has a diameter of 6 inches and the collector tube a diameter of 12 inches, the pitch preferably would be more than 3.6 inches and at least 3 inches but not more than 6 inches for such an example.

It has been found that to minimize end disturbances in the electrostatic field the helix should start more than the electrostatic gap distance, that is D-d/2 above the tube flared end 32 and terminate at the same distance below the upper end 34 of the collector tube.

It has been found that the length of the helix will be dependent upon the required corona current input, and for high efficiency performance, the most preferred helix length, i.e. one to two revolutions, should be used.

The short, i.e. two revolution helix, is less expensive to manufacture and easier to align than a longer helical electrode. Further, the closed screw flight configuration not only prevents uncharged particles from passing upwardly inside the helix, but also provides an interior for water to drain from the electrode without disrupting the electrostatic field.

If the electrode section length is reduced to one revolution, charging time must be taken into account, since in a fast flowing stream the particles may not be fully charged if the electrode is too short.

The discharge electrode mast should terminate at a distance below the collector tube end 32 so that it will have no electrical interference with the lower end of the collector tube. This distance should be about 1.0D. The diameter of the electrode mast should be from 0.24 to 0.38D and preferably is about 0.30D.

The screw flights are from 0.05 to 0.15 inch and preferably are about 0.1 inch in thickness. The outside diameter of the screw flights should be from 0.33D to 0.67D and preferably about 0.5D. The discharge electrode screw flights 22, as shown in FIG. 3, may be welded to the electrode mast and have smooth rounded ends 22a to provide a maximum electric field strength in use. If the screw flight thickness is 0.1 inch, for example, the radius of the end surface of the screw flight should be 0.05 inch.

The length of the collector tube may vary from about 6 feet to 12 feet and the length of the discharge electrode screw flight would be determined by the amount of corona current required. For most uses, two helix revolutions will be sufficient.

In operation the collector tube wall is maintained wet at all times by means of sprays 36 which may spray water from below up into the tubes or down from above into the tubes and/or by condensation of water from the water vapor in the gas stream which condenses on the cooler collector tube wall. Once the particles to be removed are charged and travel to the collector tube wall they will go into suspension in the water film 25 and be washed down for discharge from the precipitator. The tube flare at the bottom carries the water away from the electrode mast as the water is released to a plenum below the electrode assembly.

It has been found that the discharge electrode configuration of the present invention gives significantly better field stability in a wet electrostatic precipitator when compared to a number of other electrode configurations.

While the reasons for better field stability are not fully understood, there are one or more features of the invention which contribute to field stability and high field strength in the precipitator. The electric field is very symmetrical between the smooth ended screw flight discharge electrode and the cylindrical collector tube. The screw flight of the discharge electrode spins the gases as they are forced or drawn through the collector tube to minimize turbulence along the collector tube surface which can cause disruptions in the water film. If there is a disturbance of the water flow there will be local sparking at a lower electric field strength between the discharge electrode and the point of disruption.

With the high current density obtainable with the screw flight electrode of the present invention, shorter sections of active discharge electrode, i.e. screw flights may be used and accordingly, can be centered better within the collector tube.

Further, because of the relatively large diameter electrode mast and spiral form of the discharge electrode any water which collects on the discharge electrode has a free drainage path down along the mast and screw flight; preventing water from accumulating along the outer rim of the screw flight where the corona current flows. Water on the outer rim of the screw flight will result in local sparking and thereby a lower operating voltage.

Table 1 below summarizes the results of comparing six different electrode configurations in a wet electrostatic precipitator. In each case the discharge electrode was positioned in a collector tube having an inner diameter of 12 inches and an overall length of 6 feet with water overflowing the upper edge of the collector tube to create a film of water running downwardly along the collector tube walls. A fan was connected above the collector tube to pull ambient air through the tube at various velocities.

TABLE 1

| Configuration No. | Electrode Configuration | Wet Wall Sparkover Voltage (Kv) | Min. Field Gap (in.) | Wet Wall Max. Field Strength (Kv/cm) | Active Elec. (ft.) | Current Density @ 100 Kv (ma/ft.) | Mast (OD) Diameter (in.) | Mast Field Strength* (Kv/cm) |
|---|---|---|---|---|---|---|---|---|
| 1. | 6" dia. screw by 1' long, 6" pitch | 122 | 3 | 15.75 | 3.30 | 1.33 | 4 | 12.01 |
| 2 | 4" dia. screw by 4' long, 4" Pitch | 113 | 4 | 11.12 | 13.20 | 0.71 | 1.66 | 8.60 |
| 3 | 5½" dia. disks 4' long, 9 disks | 85 | 3.25 | 10.42 | 12.96 | 1.10* 0.71** | 1.90 | 6.63 |
| 4 | 5½" dia. helix 4' long, 6" pitch | 130 | 3.25 | 15.75 | 12.16 | 1.26 | 1.66 | 9.90 |
| 5 | 0.1" dia. wire 6' long in tube | 60 | 5.95 | 4.92 | 6.00 | 0.97* 0.50** | — | — |

*At Extrapolated Voltage Values
**At Sparkover Voltage

As shown in Table 1, of the five electrode configurations tested, the No. 1 configuration had the best overall performance. Configuration No. 1 was made in accordance with the invention having a screw flight 1 foot long (2 revolutions) with a diameter (d) of 0.5D and with the electrode mast having a diameter of 0.33D. The pitch was the preferred D-d or 6 inches. The screw flight had a thickness of 0.1 inch with a symmetrically rounded edge.

Configuration No. 2 was also a screw flight electrode but the diameter of the mast was smaller; the overall diameter of the screw flight was at the minimum ratio of 0.33D and it was 12 revolutions in length. The current density, wet wall maximum field strength and mast field strength were better than that of Example 3 but were substantially less than for configuration 1.

maximum field strength was substantially below that of configuration 1 as well as the wet wall sparkover voltage, current density and mast field strength.

Configuration 4 was a wire helix positioned around the mast by means of wire spokes which position the helix around the central mast. In configuration 4 the wet wall maximum field strength was good, but the current density and mast field strength were below that of configuration 1. In configuration 4, however, there is a substantial gap between the mast and wire helix where dust can flow and pass through the precipitator.

Configuration No. 5 comprised a 0.1 inch diameter wire 6 feet in length. The results of Table 1 show that it was strikingly less effective than the construction of configuration No. 1.

Figure 2:
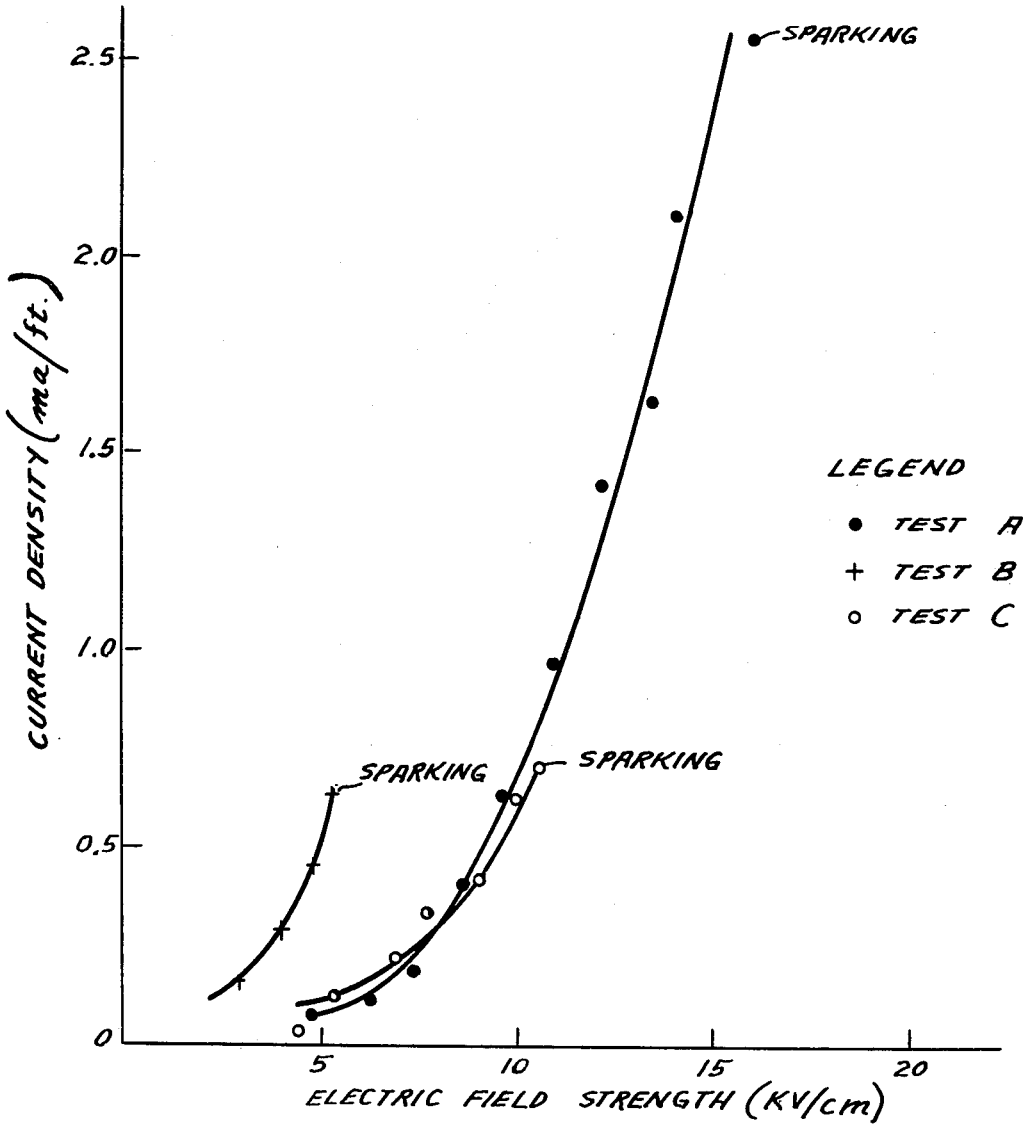
FIG. 2 is a graph showing the amount of current density in milliamps per foot versus the electric field strength in kilovolts per centimeter of the present invention compared to two different types of commonly used electrodes in a wet precipitator system.

From the data of Table 1 and other data, some of which is shown in FIG. 2, it has been found that the best results from the standpoint of wet wall maximum field strength, current density and mast field strength are obtained when the electrode mast diameter is from 0.25 to 0.40D and the other diameter of the screw flight is from 0.33 to 0.67D. It has also been found that the pitch of the screw flight should be from D-d/2 to D-d with the length of the helical screw flight being from one revolution to L-(D-d) and preferably from one to two screw revolutions. The uniformity of the electrostatic field created by the spiral electrode provides maximum field intensity before sparkover occurs. This is particularly important in a precipitator having a wet wall collector.

In FIG. 2, the current density expressed in milliamps per foot of active electrode length on circumference on the Y axis and the electric field strength in kilovolts per centimeter shown along the X axis is plotted with the sparkover points indicated at the end of the curves.

Test A was of a discharge electrode made in accordance with the invention having a one foot long screw flight with an overall diameter of 6 inches, a pitch of 6 inches and a 3 inch field gap, i.e. configuration No. 1 in Table 1.

Test B was with a discharge electrode of a 6 foot long wire having a diameter of 0.1 inch and a field gap of 5.95 inches, i.e. configuration No. 5 in Table 1.

Test C was with a discharge electrode consisting of 9 disks spaced along a mast over a four foot length, i.e. configuration No. 3 in Table 1.

The discharge electrodes were all tested in the same test collector tube which had a diameter of 12 inches and a length of 6 feet. The gas was ambient air passed through the tube at a velocity of 16.5 feet per second and in all cases water was overflowed along the collector tube inner surface at a rate of 0.5 gallons per minute.

As can be seen from FIG. 2, sparking occurred for Test A at a current density of over 2.5 milliamps per foot and an electric field strength of about 15,000 volts per centimeter. In contrast, the discharge electrode of Test B showed sparking at less than 0.7 milliamps per foot current density and at less than 6,000 volts per centimeter of electric field strength. The discharge electrode of Test C was only slightly better than Test B with sparking at a current density of about 0.7 milliamps per foot and an electric field strength of about 10,000 volts per centimeter.

In comparing two helical electrodes of different lengths the superiority of the short, i.e. 2 revolutions, helix is demonstrated.

TABLE II

| | A | | | | B | | | |
|---|---|---|---|---|---|---|---|---|
| Kilovolts | kv/cm | ma | ma/ft | watts/ft | kv/cm | ma | ma/ft | watts/ft |
| 37.2 | 4.9 | 0.4 | 0.03 | 1.1 | 4.9 | 0.3 | 0.09 | 3.14 |
| 46.5 | 6.1 | 1.0 | 0.08 | 3.5 | 6.1 | 0.4 | 0.12 | 5.6 |
| 55.8 | 7.3 | 2.4 | 0.18 | 10.2 | 7.3 | 0.7 | 0.21 | 11.8 |
| 65.1 | 8.5 | 4.4 | 0.33 | 21.7 | 8.5 | 1.4 | 0.42 | 27.6 |
| 74.4 | 9.8 | 7.2 | 0.55 | 40.6 | 9.8 | 2.2 | 0.67 | 49.6 |
| 83.7 | 11.0 | 10.6 | 0.80 | 67.3 | 11.0 | 3.2 | 0.97 | 81.2 |
| 93.0 | | | | | 12.2 | 4.6 | 1.39 | 129.6 |
| 99.2 | | | | | | | | |
| 102.3 | | | | | 13.4 | 5.7 | 1.73 | 176.7 |
| 111.6 | | | | | 14.7 | 7.0 | 2.12 | 236.7 |
| 120.9 | | | | | 15.9 | 8.5 | 2.58 | 311.4 |
| | 6" O.D. closed screw, 4' long, flight periphery 13.2', field gap 3" | | | | 6" O.D. closed screw, 1' long, flight periphery 3.3' field gap 3" | | | |

The sparkover voltage for the shorter helix (B) was 120.9 kv while for the 4 foot section (A), it was 83.7 kv. The current density was greater for the shorter electrode in terms of milliamps per unit length of flight periphery. For example, at 80 kv the short B electrode 0.82 ma/ft while the longer A electrode emits 0.70 ma/ft. As can also be seen, the B electrode is more efficient regarding power input on the basis of watts per foot with respect to voltage. For most applications, two revolutions of the screw flight should be sufficient. For those applications where a longer electrode is needed, e.g. when the gas stream is moving particularly fast, a longer electrode may be used but it generally should not have to be more than one-half L in length.

Thus, from such tests as those set forth in Tables I and II above, and in FIG. 2, the discharge electrode of the invention provides for substantially greater field strength and corona discharge than do other presently used electrode designs. Further, a short electrode of less than one-half L and preferably two revolutions or less provides a less expensive, more easily adjustable and high current density electrode for an electrostatic precipitator. The screw flight discharge electrode of the present invention is particularly useful in a wet electrostatic precipitator and provides a stable, symmetrical and high field strength electrical field in such a precipitator.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

We claim:

1. An electrostatic precipitator for the collection of particulate matter comprising:

A. a plurality of cylindrical collector tubes,
   1. said tubes being substantially circular in cross section and having an inside diameter (D) and a length (L);
   2. said collector tubes being electrically connected to form particle collection electrodes;

B. a plurality of discharge electrodes each comprising
   1. an electrode mast coaxially positioned in each collector tube and having a diameter of from 0.25 to 0.4D, and
   2. a helical discharge electrode in the form of a helical screw flight on each of said electrode masts,
      a. said helical discharge electrodes having a substantially symmetrically curved outer edge,
      b. with the outer diameter (d) of the screw flight and mast being from 0.33 to 0.67 D,
      c. a pitch of from D-d/2 to D-d,
      d. the overall length (l) of the helical screw flight being from one screw revolution to one-half L, and the helix of the discharge electrode being spaced at a distance greater than D-d/2 from each end of the collector tubes;

whereby a substantially symmetrical, high field strength and current density between the discharge electrode and the collector tube is created when high voltage is applied to said discharge electrode.

2. The electrostatic precipitator claimed in claim 1 wherein there are means for flowing water over the collector tube surface.

3. The electrostatic precipitator claimed in claim 2 wherein the lower end of each collector tube is flared outwardly to discharge water at points more distant from said electrode.

4. The electrostatic precipitator claimed in claim 1 wherein said discharge electrode mast diameter adjacent the ends of said collector tube is less than 0.3D.

5. An electrostatic precipitator for the collection of particulate matter comprising:

A. a plurality of cylindrical collector tubes,
   1. said tubes being substantially circular in cross section and having an inside diameter (D) and a length (L);
   2. said collector tubes being electrically connected to form particle collection electrodes;

B. a plurality of discharge electrodes each comprising
   1. an electrode mast coaxially positioned in each collector tube and having a diameter of from 0.25 to 0.40D, and
   2. a helical discharge electrode in the form of a helical screw flight on each of said electrode masts,
      a. said helical discharge electrodes having a substantially symmetrically curved outer edge,
      b. with the outer diameter (d) of the screw flight and mast being from 0.33 to 0.67D,
      c. a pitch of from D-d/2 to D-d,
      d. the overall length (l) of the helical screw flight being from one screw revolution to one-half L;

C. said discharge electrodes being supported by high voltage insulator beams at their upper ends and secured against lateral movement by tie rods at their lower ends,
   a. said tie rods engaging said discharge electrode mast at a distance of at least 1.0D from the bottom of said collector tubes;

whereby a substantially symmetrical, high field strength and current density between the discharge electrode and the collector tube is created when high voltage is applied to said discharge electrode.

* * * * *